US005919081A

United States Patent [19]

Hykes et al.

[11] Patent Number: 5,919,081

[45] **Date of Patent: *Jul. 6, 1999**

[54] METHOD AND APPARATUS FOR COMPUTER NUMERICALLY CONTROLLED PIN GRINDER GAUGE

[75] Inventors: Timothy W. Hykes; Ricky L. Mowen, both of Greencastle, Pa.

[73] Assignee: Unova Ip Corporation, Beverly Hills, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/707,413

[22] Filed: Sep. 4, 1996

[51] Int. Cl.[6] ..... B24B 49/00; B24B 51/00

[52] U.S. Cl. ..... 451/11; 451/5; 451/8

[58] Field of Search ..... 451/5, 57, 14, 451/8, 46, 11, 58, 249, 251, 307, 62, 9, 10

[56] References Cited

U.S. PATENT DOCUMENTS

| | | | |
|---|---|---|---|
| 4,215,962 | 8/1980 | Kreucher | 451/249 |
| 4,528,781 | 7/1985 | Koide et al. | 451/62 |
| 4,637,144 | 1/1987 | Schemel . | |
| 4,662,120 | 5/1987 | Imai et al. | 451/5 |
| 4,885,874 | 12/1989 | Wedeniwski | 451/5 |
| 4,905,418 | 3/1990 | Wedeniwski | 451/46 |
| 4,967,515 | 11/1990 | Tsjiuchi et al. | 451/10 |
| 5,103,596 | 4/1992 | Fujii et al. | 451/10 |
| 5,142,827 | 9/1992 | Phillips | 451/57 |
| 5,144,772 | 9/1992 | Kawamata et al. | 451/5 |
| 5,355,633 | 10/1994 | Ishikawa et al. | 451/5 |
| 5,367,866 | 11/1994 | Phillips | 451/14 |
| 5,392,566 | 2/1995 | Wedeniwski | 451/5 |
| 5,453,037 | 9/1995 | Lehmann | 451/8 |
| 5,562,526 | 10/1996 | Yoneda et al. | 451/10 |
| 5,679,053 | 10/1997 | Sakakura et al. | 451/10 |

*Primary Examiner*—Timothy V. Eley
*Assistant Examiner*—Derris Holt Banks
*Attorney, Agent, or Firm*—Hoffman, Wasson & Gitler

[57] ABSTRACT

A method and apparatus for grinding crankshafts or similar devices in which one of the crankpins of the crankshaft is machined and subsequent to this machine step, the actual dimension of the crankpin is measured. This measured value is compared to the projected value of the crankpin and the distance of travel of a grinding wheel in-feed is adjusted accordingly.

21 Claims, 4 Drawing Sheets

METHOD AND APPARATUS FOR COMPUTER NUMERICALLY CONTROLLED PIN GRINDER GAUGE

BACKGROUND OF THE INVENTION

1. Field of the Invention

The present invention relates to a computer numerically controlled (CNC) pin grinder gauging system for insuring that a plurality of crankshafts, camshafts or similar shafts and workpieces are properly ground.

2. Description of the Prior Art

The control of the workpiece size which have been ground by grinding machines has traditionally been accomplished by the accurate control of the axis position of the grinding wheel, an in-process gauging system or feedback from a post process gauge. Of these three methods, in-process gauging to control the grinding wheelfeed motion has traditionally been the most accurate, since it directly measures the dimensions of the workpiece being ground and eliminates the need for the machine control to compensate for thermal changes, wheel wear, machine geometry errors, and other process variables.

U.S. Pat. No. 4,637,144 issued to Schemel is typical of these in-process gauging tools. This patent monitors the diameters of crankpins during treatment in grinding machines and includes a guide 6 having a detector 4 and two sensors 3. These sensors are in the form of elongated arms or fingers with edges 5 which must be maintained in continuous contact with the peripheral surface 1B of a crankpin 1 while the axis 1A orbits or circulates along a path P. However, with the advent of precision grinding processes for parts which are not round, such as cams, and for round parts which are ground while being rotated on an axis other than their geometric center, new problems are introduced for accurately controlling the workpiece size.

The present invention describes a process and apparatus which would combine the elements of post-process gauging and in-process gauging to control the workpiece size to the degree necessary for the production of automotive crankshafts and camshafts.

SUMMARY OF THE INVENTION

The problems inherent in the prior art are addressed by the present invention which is directed to a CNC grinding process for accurately machining crankshafts having a number of crankpins which entails generating the crankpin geometry by motion of a grinding wheel in-feed axis, while the crankshaft is being rotated about or near its bearing axis. In-process gauging of the workpiece during grinding would require the gauge head to follow the crankpin through its rotation as shown in the Schemel patent. The present invention utilizes a gauge head mounted on the grinding machine which is able to measure the size of crankpins on the workpiece being ground at various points in the machine cycle. Movement of the grinding wheel, the rotation of the workpiece and the movement of the gauge head are controlled by a microprocessor provided in the machine. The micro-processor contains a memory which includes the geometry and tolerances for the various parts of the workpiece which are ground. Based upon the actual measured size of at least a portion of the workpiece, the movement of the grinding wheel is automatically controlled.

These together with other objects of the invention, along with the various features of novelty which characterize the invention, are pointed out with particularity in the claims next to and forming a part of this disclosure. For a better understanding of the invention, its operating advantages and the specific objects obtained by its uses, reference should be made to the accompanying drawings and descriptive matter in which it was illustrated preferred embodiments of the invention.

DETAILED DESCRIPTION OF THE INVENTION

Figure 1:
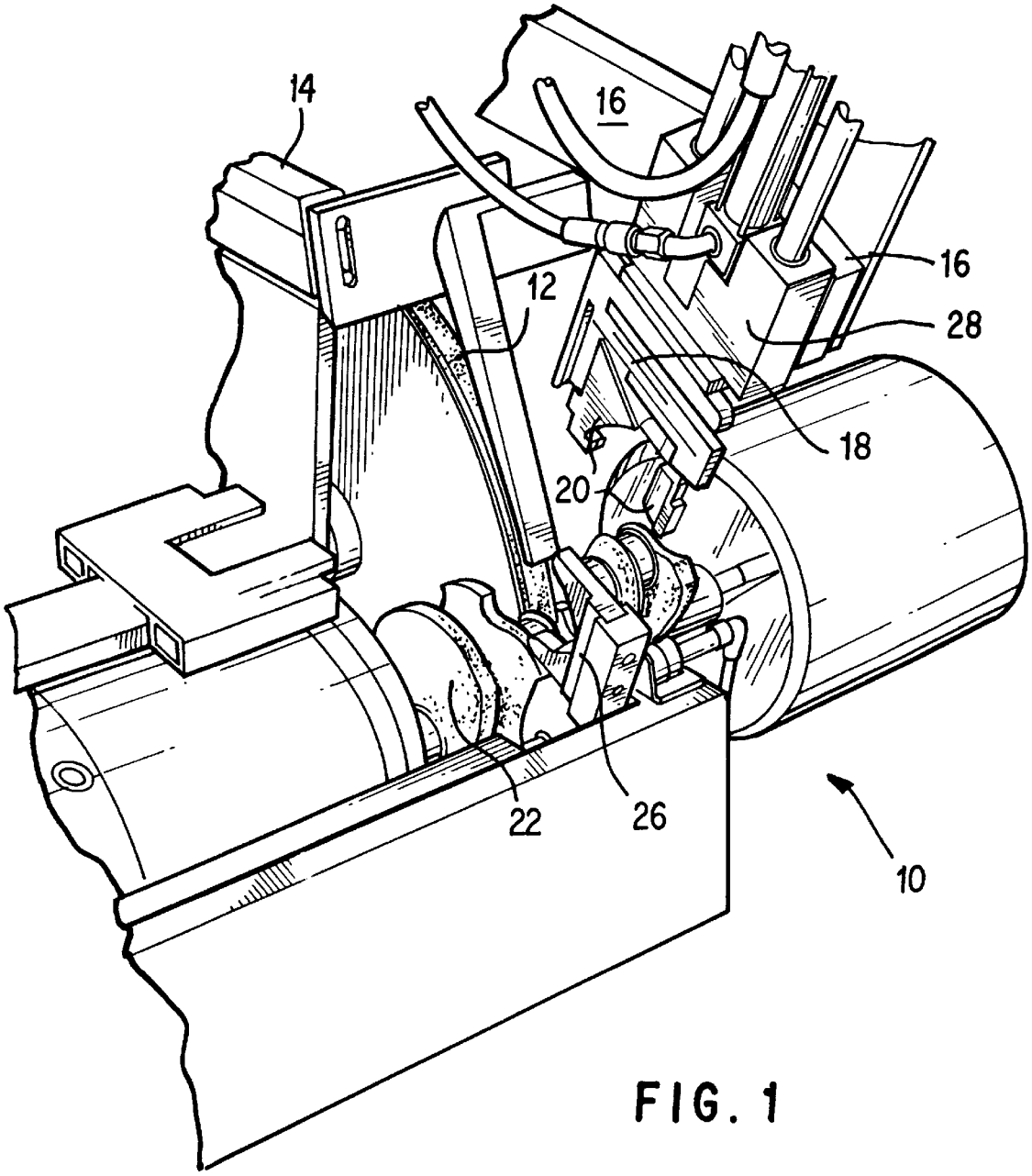
FIG. 1 is a perspective drawing of a grinding machine operating under the process of the present invention.

FIG. 1 illustrates a typical grinding machine 10 used to grind a crankshaft 22 or other workpiece having a plurality of crankpins or other grindable parts. A standard rotating grinding wheel 12 that can be advanced to or retracted from the crankshaft or workpiece is utilized. Similarly, the workpiece is affixed to the grinding machine in such a manner to allow it to rotate, as well as to be advanced or retracted in the Z-axis direction to allow various surfaces to be ground by the grinding wheel 12. Various clamps 24 and 26 are used to clamp the workpiece in its proper position.

A gauge 18 is attached to a moveable support 28 which will allow the gauge to contact a surface, such as a crankpin which has been subjected to the grinding action of the grind wheel 12. Lateral supports 14 and 16 are used to provide various connections used to move the support 28 to the crankpin. It is noted that the carriage traverse moves the work along the Z axis to position the portion of the workpiece to be ground in front of the grinding wheel 12 or gauge 18. The gauge does not move along the lateral X-axis or the vertical Y-axis. The gauge 18 is provided with two moveable jaws 20 which would allow the gauge to accurately measure the size of a particular crankpin or other machined piece.

Figure 4:
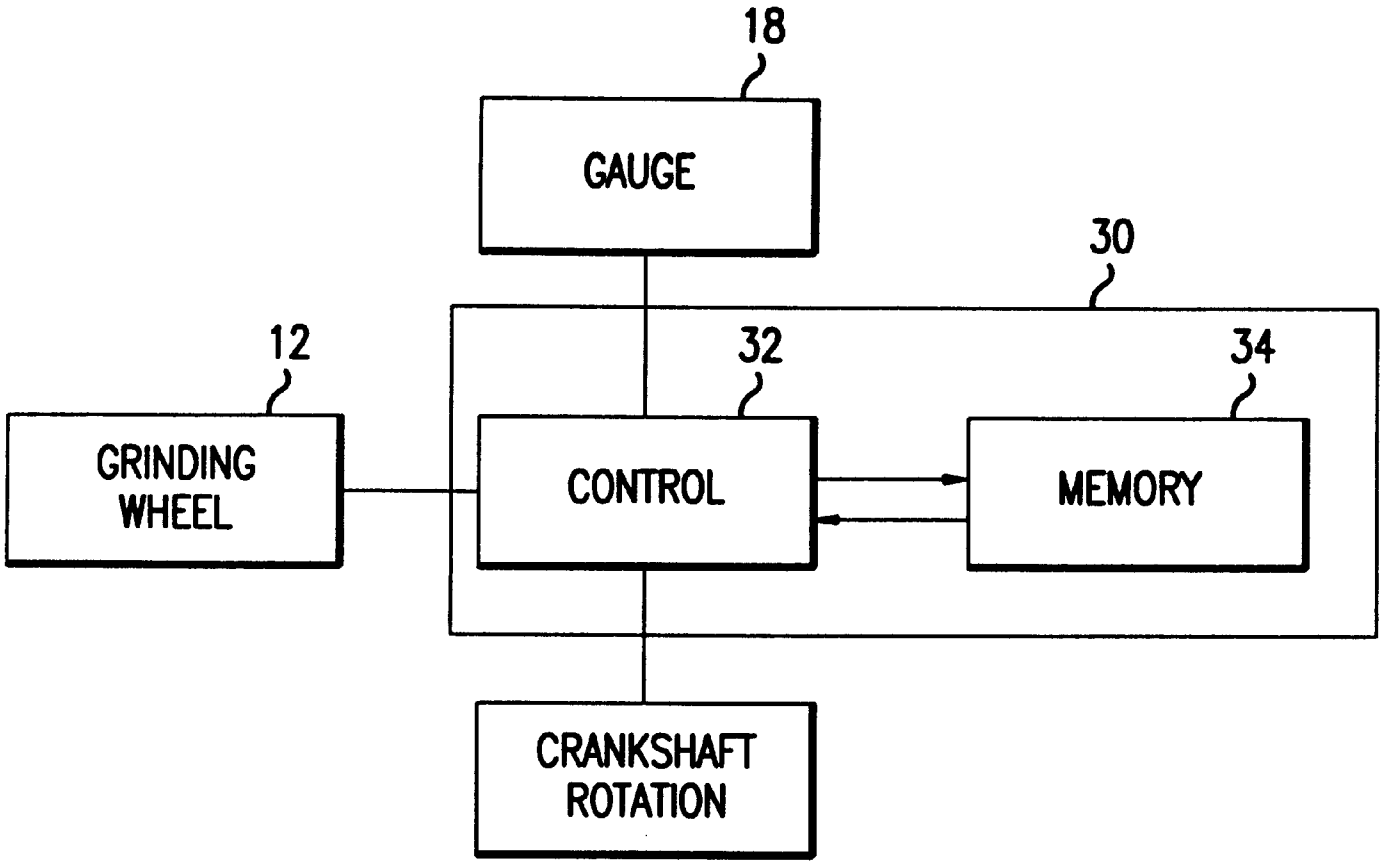
FIG. 4 is a block diagram of the control system for the present invention.

FIG. 4 illustrates a typical micro processor control 30 used to control the operation of the grinding machine 10. This control would include a controllable memory 34 such as an EPROM, EEPROM or similar memory, which would include various algorithms for operating the grinding machine as well as various parameters such as the size of each of the machined crankpins as well as tolerances for each of these pins. The memory 34 is connected to a control device 32 which would control the operation of the gauge 18, the grinding wheel 12 as well the rotation of the crankshaft during the grinding operation. Based upon the sensed measurement of one or more crankpins, the distance that the grinding wheel 12 would travel to grind the measured crankpin or a subsequent crankpin will be altered.

Figure 2:
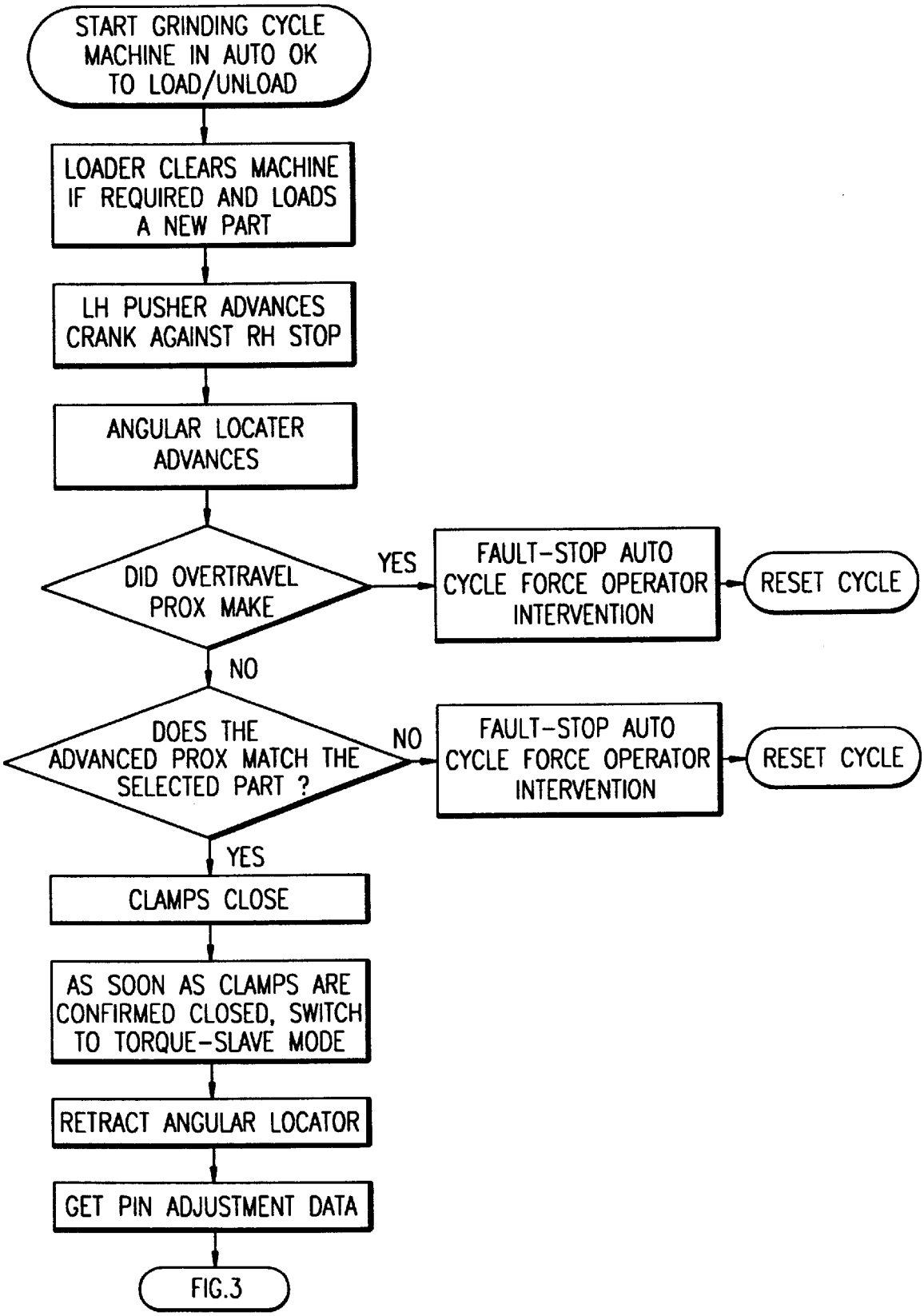
FIGS. 2 and 3 are flow diagrams of the present invention.
Figure 3:
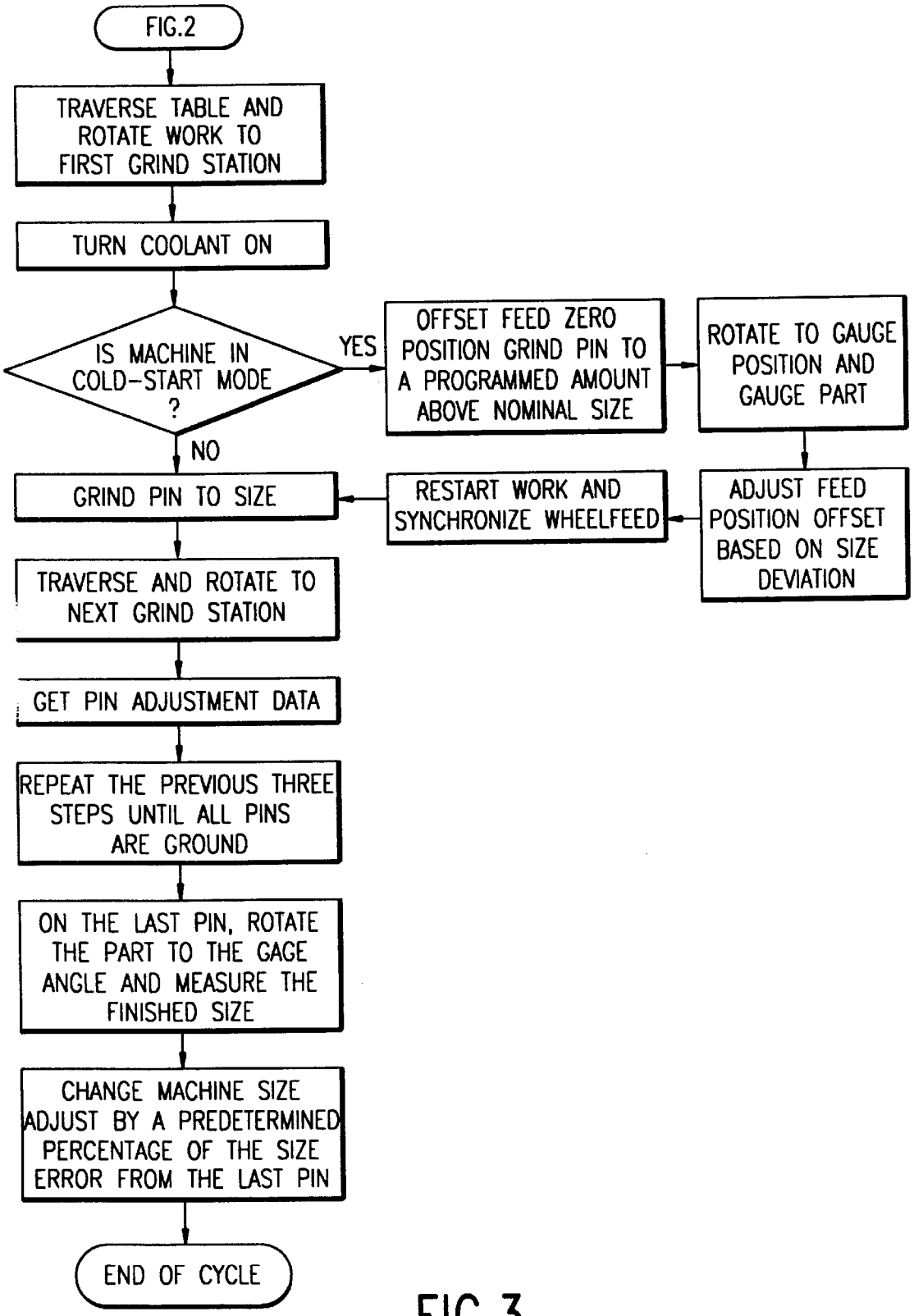

FIGS. 2 and 3 illustrates the operation of the grinding process according to the present invention. Initially, the memory 34 provided in the microprocessor control 30 is loaded with the specific size of each crankpin to be machined as well as tolerances for each of these crankpins. Furthermore, an algorithm is included in the memory 34 which would alter the in-feed distance of the grinding wheel 12 based upon measured values of one or more crankpins. Once this information is provided in the memory, the grinding machine is cleared to accept a new workpiece, such as a crankshaft having a number of crankpins which must be machined. A left hand pusher would be advanced to secure the crankpin against a right-handed stop. Obviously, a right-handed pusher could be utilized which would advance against a left-handed stop with the crankshaft therebetween. Once the crankshaft is secured in place, an angular locator would rotate the crankshaft so that it is in the proper location for the first pin to be ground and subsequently measured by the gauge 18. Proximity switches are included in the grinding machine to insure that the crankshaft is in its proper position, and whether the proper crankshaft or the workpiece has been inserted into the machine. If the crankshaft is not properly positioned, or if the improper crankshaft has been inserted into the grinding machine, the automatic cycle of the grinding machine would be interrupted to force operator intervention. Once the problem has been alleviated, the cycle would be reinitiated. The clamps securing the crankshaft to the grinding machine would then close and the rotation of the crankshaft would be in the torque/slave mode. At this point, the angular locator would be retracted and the proper dimension of the first crankpin would be accessed from the memory 34. The grinding wheel 12 would be moved to its proper position to grind the first crankpin and a coolant for cooling the grinding machine would be engaged.

If the grinding machine is in the cold-start mode, meaning that it has been dormant for a period of time, the grinding wheel will grind the crankpin to a programmed size slightly larger than the projected finished size of the crankpin. The grinding wheel is then retracted from its grinding position and the gauge 18 is moved into position to measure the size of this first crankpin. The actual size of this crankpin is then compared to the projected size of the pin and the wheel feed is synchronized accordingly. This new wheel feed distance would be inputted into the memory 34 of the microprocessor 30 to subsequently control the movement of the grinding wheel 12. The gauge 18 is then retracted and the grinding wheel 12 is advanced to grind the first crankpin to size. The grinding wheel 12 is then retracted and the crankshaft 22 is moved to its next position for grinding the second crankpin. The pin adjustment data which was obtained by comparing the projected size of the first crankpin to its measured size in the cold-start mode, would be used to advance the grinding wheel 12 for a distance to grind the second crankpin to its proper size. It is noted that no measurement of the second crankpin is made. The grinding wheel is then retracted and the third crankpin is moved into position to be ground by the grinding wheel 12. All subsequent crankpins are ground in this manner. At this point, this first crankshaft is removed and a second crankshaft is inserted into its place and the machining of this crankshaft is continued in the cold-start mode as outlined hereinabove. This cold-start mode would continue for a predetermined amount of time or a predetermined number of crankshafts, such as five. It is noted that in the cold-start mode, only the first of the crankpins of any crankshaft is measured.

Once a predetermined number of crankshafts have been machined, or a predetermined time has elapsed, the grinding machine will begin to operate in the normal mode. When the grinding machine is operating in the normal mode, the first crankpin of the crankshaft would be machined based upon the measurement made with respect to the last measured crankpin. In this mode, the first crankpin of each of the crankshafts is machined without any measurement. Once the last crankpin of the crankshaft is machined by the grinding wheel 12 operating in the normal mode, the size of this crankpin is measured and compared to the projected size of that crankpin. If the measured size equals the projected size, the crankshaft is removed from the machine and a new crankshaft to be machined is inserted into the grinding machine. If the measured size does not equal the projected size, but is within a particular tolerance, the distance of the grinding wheel in-feed is adjusted by a predetermined percentage of the size error of this pin. It is noted that this last measured crankpin would not be reground. However, the distance of the grinding wheel in-feed would be changed accordingly. However, if the difference between the projected size of the crankpin and the actual measured size of the crankpin falls beyond this tolerance, the grinding machine will be faulted and the production would be stopped until a correction is made to the machine. It is noted that when the grinding machine is operating in the normal mode, a measurement is made only to the last crankpin of a particular crankshaft. Alternatively, when the machine is operating in the normal mode, it might not be necessary to measure each of the last crankpins of any crankshaft if the machine is sensed to be operating very close to the projected values of the crankpins. In this instance, measurements could be made to every second or third or fourth crankshaft, etc.

It is important to note that the teachings of the present invention need not be utilized only when machining or grinding a workpiece have a number of successive grindable surfaces which will be ground to the same dimension, but could be employed if the workpiece includes only a single surface to be ground.

It is understood that the invention is not confined to the particular construction and arrangement herein and illustrated and described but embraces such modified forms thereof as come within the scope of the following claims.

What is claimed:

1. A method of grinding a workpiece having one or more surfaces which are each to be ground to an equal dimension, by a grinding machine provided with a grinding wheel and a measurement gauge, comprising the steps of:

inputting at least one algorithm as well as a plurality of parameters relating to the workpiece to be ground, in a memory provided in a microprocessor used to control the grinding machine;

inserting and securing the workpiece in the grinding machine;

advancing the workpiece to a position for grinding a first surface of the workpiece;

initiating rotation of the workpiece;

advancing the grinding wheel from a start position to said first surface;

grinding said first surface by advancing the grinding wheel a predetermined first distance from said start position based upon information provided in the memory, said first predetermined distance greater than the distance from said start position to said first surface and purposely less than the distance between said start position and a projected value, said predetermined first distance always less than the distance between said start position and said projected value, said grinding step removing material from said first surface to create a ground surface;

retracting the grinding wheel and ceasing rotation of the workpiece;

advancing the measurement gauge to said ground surface to measure the amount of material removed in said grinding step to produce a measured value;

retracting the measurement gauge from said ground surface;

comparing said measured value to said projected value;

calculating a second distance of advancement for the grinding wheel and inputting said second distance in the memory of the microprocessor; and advancing the grinding wheel said second distance to further grind said ground surface as the workpiece rotates.

2. The method in accordance with claim 1 further including the steps of:

subsequent to said advancing the grinding wheel said second distance step, advancing the workpiece to a position for grinding a second surface of the workpiece; and advancing the grinding wheel said second distance to grind said second surface as the workpiece rotates.

3. The method in accordance with claim 2, further including the steps of:

grinding a predetermined number of workpieces in the manner recited in claim 1;

inserting and securing a subsequent workpiece on the grinding machine, said workpiece provided with a plurality of successive surfaces to be ground;

advancing the workpiece to a position for grinding the first of said surfaces of the workpiece;

initiating rotation of the workpiece;

advancing the grinding wheel to said first surface;

grinding said first surface by advancing said grinding wheel a predetermined distance determined by the last calculating step;

grinding each of the successive surfaces of the workpiece the same distance as the previous grinding step;

retracting the grinding wheel by the last of said successive surfaces after said last surface has been ground;

advancing the measurement gauge to measure the dimension of the last of said successive surfaces to produce a projected value;

comparing said measured value of said last of said successive surfaces to the said projected value of said last of said successive surfaces;

recalculating a third distance of advancement for the grinding wheel and inputting said third distance in the memory of the microprocessor; and removing the workpiece from the grinding machine.

4. The method in accordance with claim 2 further including the steps of:

inserting and securing a workpiece in the grinding machine;

grinding each of the surface of the workpiece by advancing the grinding wheel said second distance.

5. The method in accordance with claim 2 further including the steps of:

subsequent to said advancing the grinding wheel said second distance to grind said second surface step successively advancing the workpiece to all subsequent surfaces to be ground;

successively advancing the grinding wheel said second distance to grind each of said subsequent surfaces as the workpiece rotates; and removing the workpiece from the grinding machine.

6. The method in accordance with claim 5 further including the steps of:

inserting and securing a subsequent workpiece in the grinding machine;

advancing said subsequent workpiece to a position for grinding a first surface of said subsequent workpiece;

initiating rotation of said subsequent workpiece:

advancing the grinding wheel to said first surface of said subsequent workpiece;

grinding said first surface of said subsequent workpiece by advancing the grinding wheel said second distance to remove material from said first surface to create a ground surface of said subsequent workpiece;

retracting the grinding wheel and ceasing rotation of the workpiece;

advancing the measurement gauge to measure the amount of material removed from said subsequent workpiece in said previous grinding step to produce a second measured value;

retracting the measurement gauge from said ground surface of said subsequent workpiece;

comparing said second measured value to a second projected value;

calculating a third distance of advancement for the grinding wheel and inputting said third distance in the memory of the microprocessor; and advancing the grinding wheel said third distance to further grind said ground surface of said subsequent workpiece.

7. The method in accordance with claim 5, further including the steps of:

grinding a predetermined number of workpieces in the manner recited in claim 1;

inserting and securing a subsequent workpiece on the grinding machine, said workpiece provided with a plurality of successive surfaces to be ground;

advancing the workpiece to a position for grinding the first of said surfaces of the workpiece;

initiating rotation of the workpiece;

advancing the grinding wheel to said first surface;

grinding said first surface by advancing said grinding wheel a predetermined distance determined by the last calculating step;

grinding each of the successive surfaces of the workpiece the same distance as the previous grinding step;

retracting the grinding wheel by the last of said successive surfaces after said last surface has been ground;

advancing the measurement gauge to measure the dimension of the last of said successive surfaces to produce a projected value;

comparing said measured value of said last of said successive surfaces to the said projected value of said last of said successive surfaces;

recalculating a third distance of advancement for the grinding wheel and inputting said third distance in the memory of the microprocessor; and removing the workpiece from the grinding machine.

8. The method in accordance with claim 5 further including the steps of:

inserting and securing a workpiece in the grinding machine;

grinding each of the surface of the workpiece by advancing the grinding wheel said second distance.

9. The method in accordance with claim 5 further including the steps of:

inserting and securing a subsequent workpiece in the grinding machine;

advancing said subsequent workpiece to a position for grinding a first surface of said subsequent workpiece;

initiating rotation of said subsequent workpiece:

advancing the grinding wheel to said first surface of said subsequent workpiece;

grinding said first surface of said subsequent workpiece by advancing the grinding wheel said second distance;

retracting the grinding wheel and ceasing rotation of the workpiece.

10. The method in accordance with claim 9, further including the step of:

prior to said removing step, advancing the workpiece to a position for grinding a second surface of said subsequent workpiece.

11. The method in accordance with claim 10, further including the step of:

prior to said removing step, successively advancing said subsequent workpiece to all subsequent surfaces to be ground.

12. The method in accordance with claim 6, further including the steps of:

grinding a predetermined number of workpieces in the manner recited in claim 1;

inserting and securing an additional workpiece on the grinding machine, said additional workpiece provided with a plurality of successive surfaces to be ground;

advancing said additional workpiece to a position for grinding the first of said surfaces of said additional workpiece;

initiating rotation of the workpiece;

advancing the grinding wheel to said first surface;

grinding said first surface by advancing said grinding wheel a predetermined distance determined by the last calculating step;

grinding each of the successive surfaces of said additional workpiece the same distance as the previous grinding step;

retracting the grinding wheel by the last of said successive surfaces after said last surface has been ground;

advancing the measurement gauge to measure the dimension of the last of said successive surfaces to produce a projected value;

comparing said measured value of said last of said successive surfaces to the said projected value of said last of said successive surfaces;

recalculating a third distance of advancement for the grinding wheel and inputting said third distance in the memory of the microprocessor; and removing said additional workpiece from the grinding machine.

13. The method in accordance with claim 6 further including the steps of:

inserting and securing a workpiece in the grinding machine;

grinding each of the surface of the workpiece by advancing the grinding wheel said third distance.

14. The method in accordance with claim 6, further including the steps of:

prior to said removing step, advancing the workpiece to a position for grinding a second surface of said subsequent workpiece; and advancing the grinding wheel said third distance to grind said second surface of said subsequent workpiece.

15. The method in accordance with claim 14, further including the steps of:

grinding a predetermined number of workpieces in the manner recited in claim 1;

inserting and securing an additional workpiece on the grinding machine, said additional workpiece provided with a plurality of successive surfaces to be ground;

advancing said additional workpiece to a position for grinding the first of said surfaces of said additional workpiece;

initiating rotation of said additional workpiece;

advancing the grinding wheel to said first surface;

grinding said first surface by advancing said grinding wheel a predetermined distance determined by the last calculating step;

grinding each of the successive surfaces of said additional workpiece the same distance as the previous grinding step;

retracting the grinding wheel by the last of said successive surfaces after said last surface has been ground;

advancing the measurement gauge to measure the dimension of the last of said successive surfaces to produce a projected value;

comparing said measured value of said last of said successive surfaces to the said projected value of said last of said successive surfaces;

recalculating a third distance of advancement for the grinding wheel and inputting said third distance in the memory of the microprocessor; and removing said additional workpiece from the grinding machine.

16. The method in accordance with claim 14 further including the steps of:

inserting and securing a workpiece in the grinding machine;

grinding each of the surface of the workpiece by advancing the grinding wheel said third distance.

17. The method in accordance with claim 14, further including the steps of:

prior to said removing step, successively advancing said subsequent workpiece to all subsequent surfaces to be ground; and successively advancing the grinding wheel said third distance to grind each of said subsequent surfaces as said subsequent workpiece rotates.

18. The method in accordance with claim 17, further including the steps of;

grinding a predetermined number of workpieces in the manner recited in claim 1;

inserting and securing an additional workpiece on the grinding machine, said additional workpiece provided with a plurality of successive surfaces to be ground;

advancing said additional workpiece to a position for grinding the first of said surface of said additional workpiece;

initiating rotation of the workpiece;

advancing the grinding wheel to said first surface;

grinding said first surface by advancing said grinding wheel a predetermined distance determined by the last calculating step;

grinding each of the successive surfaces of the workpiece the same distance as the previous grinding step;

retracting the grinding wheel by the last of said successive surfaces after said last surface has been ground;

advancing the measurement gauge to measure the dimension of the last of said successive surfaces to produce a projected value;

comparing said measured value of said last of said successive surfaces to the said projected value of said last of said successive surfaces;

recalculating a third distance of advancement for the grinding wheel and imputting said third distance in the memory of the microprocessor; and removing the workpiece from the grinding machine.

19. The method in accordance with claim 17 further including the steps of:

inserting and securing a workpiece in the grinding machine;

grinding each of the surface of the workpiece by advancing the grinding wheel said third distance.

20. The method in accordance with claim 1, further including the steps of;

grinding a predetermined number of workpieces in the manner recited in claim 1;

inserting and securing a subsequent workpiece on the grinding machine, said workpiece provided with a plurality of successive surfaces to be ground;

advancing the workpiece to a position for grinding the first of said surfaces of the workpiece;

initiating rotation of the workpiece;

advancing the grinding wheel to said first surface;

grinding said first surface by advancing said grinding wheel a predetermined distance determined by the last calculating step;

grinding each of the successive surfaces of the workpiece the same distance as the previous grinding step;

retracting the grinding wheel by the last of said successive surfaces after said last surface has been ground;

advancing the measurement gauge to measure the dimension of the last of said successive surfaces to produce a projected value;

comparing said measured value of said last of said successive surfaces to the said projected value of said last of said successive surfaces;

recalculating a third distance of advancement for the grinding wheel and inputting said third distance in the memory of the microprocessor; and removing the workpiece from the grinding machine.

21. The method in accordance with claim 1, further including the step of moving the workpiece to a position to measure the amount of material removed in said grinding step.

* * * * *